US005222116A

United States Patent [19]

Eloff et al.

[11] Patent Number: 5,222,116

[45] Date of Patent: Jun. 22, 1993

[54] METALLIC ALLOY FOR X-RAY TARGET

[75] Inventors: Peter C. Eloff, Cleveland Heights; Gregory Reznikov, Akron, both of Ohio

[73] Assignee: General Electric Company, Milwaukee, Wis.

[21] Appl. No.: 907,892

[22] Filed: Jul. 2, 1992

[51] Int. Cl.[5] ..... H01J 35/08

[52] U.S. Cl. ..... 378/143; 378/125; 378/128; 378/144; 420/429

[58] Field of Search ..... 378/143, 144, 127, 128, 378/125; 420/429

[56] References Cited

U.S. PATENT DOCUMENTS

| | | | |
|---|---|---|---|
| 3,689,795 | 9/1972 | Benesovsky | 378/144 |
| 3,710,170 | 1/1973 | Friedel | 378/144 |
| 3,890,521 | 6/1975 | Shroff | 378/144 |
| 4,004,174 | 1/1977 | Yasgiro | 378/144 |
| 4,165,982 | 8/1979 | Tatsuo et al. | 420/429 |
| 4,657,735 | 4/1987 | Whelan et al. | 420/429 |
| 4,777,643 | 10/1988 | Devine, Jr. | 378/144 |
| 4,780,902 | 10/1988 | Eck | 378/144 |
| 5,159,619 | 10/1992 | Benz et al. | 378/143 |

*Primary Examiner*—David P. Porta
*Assistant Examiner*—Kim-Twok Chu
*Attorney, Agent, or Firm*—Quarles & Brady

[57] ABSTRACT

An X-ray tube anode which is composed of a refractory metal having a focal track thereon with the refractory metal including tantalum, hafnium, zirconium and carbon in a minor amount and molybdenum in a major amount. The anode has improved high temperature properties and fabricability. It can be utilized alone or in combination with the usual graphite portion.

17 Claims, 1 Drawing Sheet

METALLIC ALLOY FOR X-RAY TARGET

BACKGROUND OF THE INVENTION

This invention relates to X-ray tube anode targets and, more particularly, to a metallic alloy for manufacturing a refractory metal anode target.

There is a continuous demand for higher temperature alloys for manufacturing X-ray tube anode targets. This has led to the development of a series of compositions based on molybdenum. The most widely used alloys were and still are molybdenum-titanium-zirconium-carbon (TZM and TZC).

U.S. Pat. Nos. 4,004,174; 4,165,982; 4,657,735 and, 4,780,902 all describe molybdenum based alloys. In U.S. Pat. No. 4,004,174 molybdenum is combined with titanium and/or zirconium to provide an X-ray target structure. In the remaining patents molybdenum is combined with hafnium and carbon, with zirconium also described in the '982 and 902 patents.

Solution-strengthened alloys, such as Mo-W, Mo-V, Mo-Cb, etc. are known in the prior art literature but either do not have enough high temperature strength or create difficulties during manufacturing.

For several years, molybdenum base alloys were being developed, using hafnium and zirconium as alloying elements. All these compositions were considered to be carbide-strengthened alloys and were distinguished one from another by the metal-to-carbon ratio. There were also several attempts to develop theoretical explanations for such alloy designs, but nevertheless it is still not clear what is the best combination. This undoubtedly depends on the application of these alloys, their process history, thermomechanical treatment, etc.

Historically, arc-cast molybdenum alloys, extruded to a certain degree, were the first and are still very important products. During production these alloys undergo considerable amounts of hot work. High deformation (typically 50–95%) takes place during the production of these alloys using swaging, forging, extrusion, etc.

For bimetal X-ray target production via powder metallurgy, where the amount of hot work is limited by the tungsten or tungsten-rhenium layer flowability, forging reduction is in the range of 10–40% which is, typically, the critical level of deformation for alloys with high concentration of alloying elements. That is why commercially available carbide-strengthened alloys do not work satisfactorily or have low process yields due to poor workability during forging.

Therefore, a new series of alloys, where a hybrid structure can be beneficial, is developed herein. In designing this group of alloys the aim and theory is to combine carbide and solution strengthening in one alloy that can provide high temperature properties with good fabricability.

SUMMARY OF THE INVENTION

The invention provides an x-ray tube anode (target) which is composed of a molybdenum alloy substrate or body having a focal track thereon, typically of a tungstenbased alloy. The substrate or body portion is composed of a refractory metal such as tantalum, hafnium, zirconium and carbon in minor amounts. Molybdenum is present in a major amount.

In one aspect, the tantalum, hafnium, zirconium and carbon are present in minor amounts in the range of about 0.5 to 2.5% by weight with the molybdenum being present in amounts in the range of about 99.5 to 97.5% by weight.

In another aspect, tantalum is present in the range of about 0.20–0.75%, hafnium in the range of about 0.15 to 0.75%, zirconium present in the range of about 0.15–0.5% and carbon present in the range of about 0.0220–0.3580%, with the balance of 100% being molybdenum. All percentage amounts stated herein are by weight.

In one preferred manner the metallic alloy would contain about 0.20–0.40% tantalum, 0.20–0.40% hafnium, 0.20–0.40% zirconium, 0.04–0.07% carbon and the balance molybdenum.

In another preferred manner, the metallic alloy would contain 0.20% tantalum, 0.15% hafnium, 0.15% zirconium and 0.0760% carbon with the balance being molybdenum.

In another aspect, there is presented an x-ray tube anode as previously described which can be employed either with or without a graphite substrate portion.

It is an object of the present invention to provide an X-ray tube anode having high temperature properties and fabricability.

Another object is an X-ray tube anode of the foregoing type which has increased strength.

Still another object is to provide an X-ray tube anode of the foregoing type wherein there is a decrease in the warpage between the anode body and the focal track.

These objects and other features and advantages will become more readily apparent upon reference to the following description when taken in conjunction with the appended drawing.

DESCRIPTION OF A PREFERRED EMBODIMENT

Figure 1:
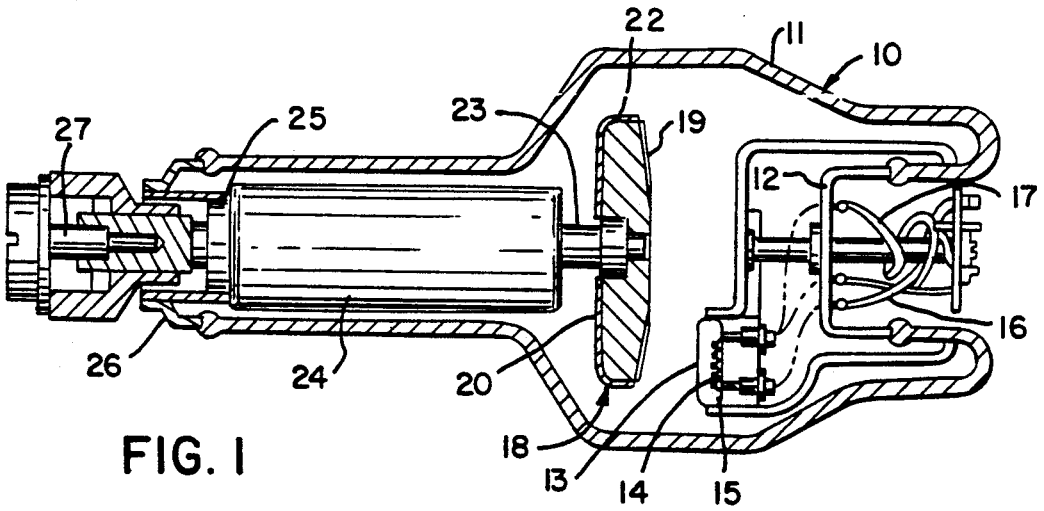
FIG. 1 is a typical rotating anode X-ray tube, shown in section, in which the anode of this invention is used.

In FIG. 1, an illustrative X-ray tube generally 10 comprises a glass envelope 11 which has a cathode support 12 sealed into one end. A cathode structure 13 comprising an electron emissive filament 14 and a focusing cup 15 is mounted to support 12. There are a pair of conductors 16 for supplying heating current to the filament and another conductor 17 for maintaining the cathode at ground or negative potential relative to the target of the tube.

The anode or target on which the electron beam from the cathode 13 impinges to produce X-radiation is generally designated by the reference numeral 18. Target 18 constitutes the subject of this invention. It is composed of a refractory metal containing tantalum, hafnium, zirconium and carbon in a minor amount and molybdenum in a major amount as more fully described herein. A surface layer on which the electron beam impinges while the target is rotating to produce X-rays is marked 19 and is shown in crosssection in FIGS. 1 and 2. Surface layer 19 is commonly composed of tungstenrhenium alloy for well-known reasons and composes the focal track.

The rear surface 20 of target 18 in this example can be covered with a high thermal emittance coating such as described in commonly assigned U.S. Pat. No. 4,953,190.

In FIG. 1 the target 18 is fixed on a shaft 23 which extends from a rotor 24. The rotor is journaled on an internal bearing support 25 which is, in turn, supported from a ferrule 26 that is sealed into the end of the glass tube envelope 11. The stator coils for driving rotor 24 such as an induction motor are omitted from the drawing. High voltage is supplied to the anode structure and target 18 by a supply line, not shown, coupled with a connector 27.

As is well known, rotary anode x-ray tubes are usually enclosed within a casing, not shown, which has spaced apart walls between which oil is circulated to carry away the heat that is radiated from rotating target 18. The bulk temperature of the target may reach 1350° C. during tube operation and most of this heat has to be dissipated by radiation through the vacuum within tube envelope 11 to the oil in the tube casing which may be passed through a heat exchanger, not shown. It is common to coat the rotor 24 with a textured material such as titanium dioxide to increase thermal emittance and thereby prevent the bearings which support the rotor from becoming overheated.

The target 18 is a vital component in the X-ray tube 10. Accordingly, it is essential that it provide high temperature operating properties with good fabricability. This includes the reduction of warpage between the main body portion 30 and the focal track 19.

Figure 3:
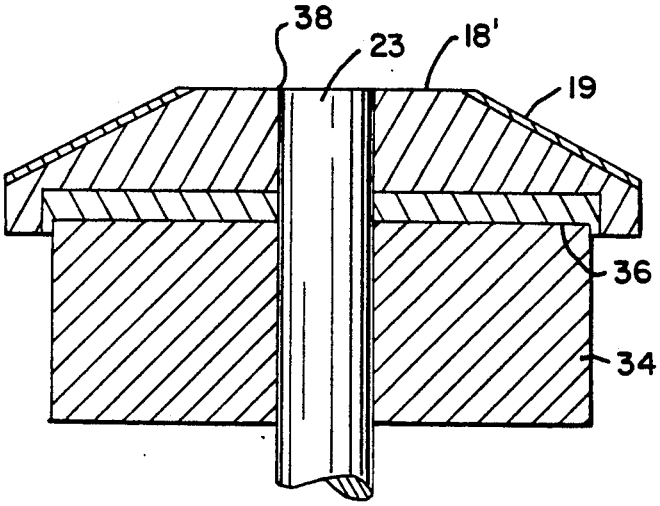
FIG. 3 is a cross section of an alternative embodiment.

FIG. 3 shows a modification of the anode target 18 as it would be employed in combination with the usual additional graphite portion 34. It is indicated by the reference numeral 18'. It is secured to the graphite portion 34 by a brazing layer 36. The target 18' and the graphite portion 34 are fitted to the rotatable shaft 23 through the bore 38. Target 18' has the usual focal track 19.

The following examples are set forth for the purpose of illustrating the present invention and should not be construed to limit the invention to the precise ingredients, proportions, temperatures or other conditions specified. In the following Examples all percentages are weight percent.

EXAMPLE 1

The target 18 is fabricated by blending 99.424% molybdenum powder with 0.20% tantalum, 0.15% hafnium, 0.15% zirconium in the hydride powder form and 0.0760% carbon. In a preferred manner a master mixture is first composed using 10% of the molybdenum powder. This master mixture is ball milled followed by final blending of the balance of the molybdenum. Cylinders having a 3 inch diameter and 1 inch height as well as actual targets having a diameter of 5 or 6.5 inches and a tungsten-10% rhenium focal track were pressed in the usual manner, at a pressure of about 20 tons per square inch. The resulting parts were sintered at 2100–2300° C. with 5 hours holding time. The parts were preheated in hydrogen at a temperature of 1500° C. followed by forging of the cylinders or targets. As a final step there is a stress relieving of the cylinders or targets and/or passing them through a heat treatment stage.

The following Table 1 represents additional examples utilizing varying amounts of materials and the procedures set forth in Example I.

TABLE 1

| Example | % Tantalum | % Hafnium | % Zirconium | % Carbon | % Molybdenum* |
|---|---|---|---|---|---|
| 2 | 0.20 | 0.15 | 0.15 | 0.0440 | balance |
| 3 | 0.25 | 0.25 | 0.25 | 0.1040 | balance |
| 4 | 0.25 | 0.25 | 0.25 | 0.0730 | balance |
| 5 | 0.25 | 0.25 | 0.25 | 0.0400 | balance |
| 6 | 0.25 | 0.25 | 0.25 | 0.0220 | balance |
| 7 | 0.25 | 0.25 | 0.25 | 0.0140 | balance |
| 8 | 0.50 | 0.50 | 0.25 | 0.1720 | balance |
| 9 | 0.50 | 0.50 | 0.25 | 0.1215 | balance |
| 10 | 0.50 | 0.50 | 0.50 | 0.2700 | balance |
| 11 | 0.50 | 0.50 | 0.50 | 0.1480 | balance |
| 12 | 0.75 | 0.75 | 0.50 | 0.3580 | balance |
| 13 | 0.75 | 0.75 | 0.50 | 0.2015 | balance |

*to compose 100%

The amounts of metal alloying elements were determined using a Direct Current Plasma technique for the metals and an analyzer from the Leco Company for determining the carbon. The amounts indicated for the carbon are actual numbers whereas the error in determining the amounts of metal alloying elements did not exceed 5%.

The following Tables illustrate the testing in yield strength of the target products produced in the preceding Examples. In Table 2 the test temperature was 1400° C. whereas in Table 3 it was 1700° C. The yield strength was measured in terms of thousand pounds per square inch (KPSI).

TABLE 2

| Example | Yield Strength |
|---|---|
| 1–2 | 45 |
| 3–7 | 43 |
| 8–9 | 42 |
| 10–11 | 43 |
| 12–13 | 46 |

The test results of products stated in Table 2 were compared with a standard General Electric target material composed of TZM which had a yield strength of 15 KPSI.

TABLE 3

| Example | Yield Strength |
|---|---|
| 1–2 | 20 |
| 3–7 | 14 |
| 8–9 | 17 |
| 10–11 | 14 |
| 12–13 | 17 |

The test results of the products stated in Table 3 were also compared with a standard General Electric TZM target material which had a yield strength of 8 KSI.

As is recognized in producing X-ray targets of the type concerned with in this invention, carbon is employed to control undesired oxygen. While a minimum amount of carbon is desired because of its effect in reducing strength, it was found that an amount of 0.0140% carbon in Example 7 is too low for some applications as the oxygen content is too high. Further tests conducted in connection with the composition of this invention show that a retained carbon content of about 0.0400% is desired from a strength standpoint.

It is seen from the test data presented herein that an increase of 3X the strength for an X-ray anode is achieved when compared to a standard unit under certain temperature conditions. This increase in strength is attributable to the incorporation of tantalum which prior to this invention had not been used in combination with the other specified metals. The test data also shows quite unexpectedly that the formulation of Examples 1 and 2 with the lower amounts of tantalum, halfnium and zirconium performed as well as the formulations of Examples 12–13 with the larger amounts of these materials. Obviously, from an economic standpoint the formulation of Examples 1 and 2 are preferred.

Figure 2:
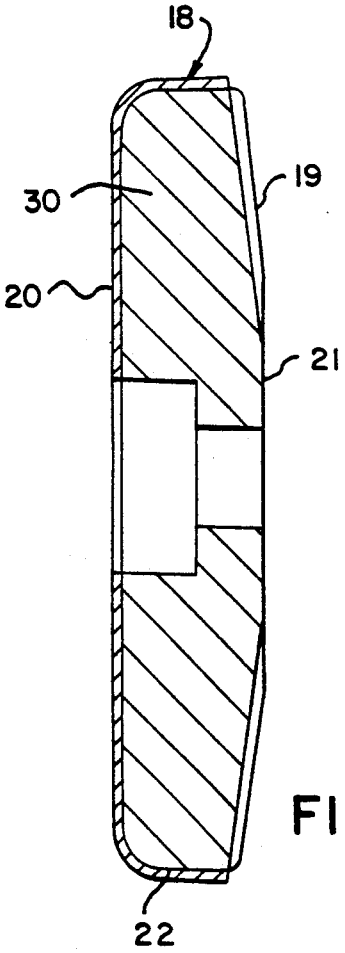
FIG. 2 is a cross section of the X-ray anode body shown in FIG. 1.

The formulation of this invention can be employed to produce an anode target 18, which can be used by itself as illustrated in FIGS. 1 and 2 of the drawing or in combination with a graphite disk portion as shown in FIG. 3.

We claim:

1. An X-ray tube anode composed of a molybdenum alloy body having a focal track thereon, said body consisting essentially of:

tantalum, hafnium, zirconium and carbon present in a minor amount, with said carbon present in an amount greater than 0.0140% by weight; and molybdenum present in a major amount.

2. The X-ray tube anode as defined in claim 1 wherein said minor amount is in the range of about 0.5 to 2.5% by weight and said major amount is in the range of about 99.5 to 97.5% by weight.

3. The X-ray tube anode as defined in claim 1 wherein said tantalum is present in the range of about 0.20–0.75% by weight, said hafnium is present in the range of about 0.15 to 0.75% by weight, said zirconium is present in the range of about 0.15–0.50% by weight, and said carbon is present in the range of about 0.0220–0.3580% by weight.

4. The X-ray tube anode as defined in claim 1 wherein said tantalum is present in the range of about 0.20–0.40% by weight, said hafnium is present in the range of about 0.20–0.40% by weight, said zirconium is present in the range of about 0.20–0.40% by weight and said carbon is present in the range of about 0.04–0.07% by weight.

5. The X-ray tube anode as defined in claim 1 wherein said tantalum is present in an amount of 0.20% by weight, said hafnium is present in an amount of 0.15% by weight, said zirconium is present in an amount of 0.15% by weight, said carbon is present in an amount of 0.0760% and a remaining balance of 100% is molybdenum.

6. The X-ray tube anode as defined in claim 1 wherein said tantalum is present in an amount of 0.20% by weight, said hafnium is present in an amount of 0.15% by weight, said zirconium is present in an amount of 0.15% by weight, said carbon is present in an amount of 0.0440% by weight and a remaining balance of 100% is molybdenum.

7. The X-ray tube anode as defined in claim 1 wherein said tantalum is present in an amount of 0.25% by weight, said hafnium is present in an amount of 0.25% by by weight, said carbon is present in an amount of 0.1040% by weight and a remaining balance of 100% is molybdenum.

8. The X-ray tube anode as defined in claim 1 wherein said tantalum is present in an amount of 0.25% by weight, said hafnium is present in an amount of 0.25% by weight, said zirconium is present in an amount of 0.25% by weight, said carbon is present in an amount of 0.0730% by weight and a remaining balance of 100% is molybdenum.

9. The X-ray tube anode as defined in claim 1 wherein said tantalum is present in an amount of 0.25% by weight, said hafnium is present in an amount of 0.25% by weight, said zirconium is present in an amount of 0.25% by weight, and said carbon is present in an amount of 0.0400% by weight and a remaining balance of 100% is molybdenum.

10. The X-ray tube anode as defined in claim 1 wherein said tantalum is present in an amount of 0.25% by weight, said hafnium is present in an amount of 0.25% by weight, said zirconium is present in an amount of 0.25% by weight, and said carbon is present in an amount of 0.0220% by weight and a remaining balance of 100% is molybdenum.

11. The X-ray tube anode as defined in claim 1 wherein said tantalum is present in an amount of 0.50% by weight, said hafnium is present in an amount of 0.50% by weight, said zirconium is present in an amount of 0.25% by weight, and said carbon is present in an amount of 0.1720% by weight and a remaining balance of 100% is molybdenum.

12. The X-ray tube anode as defined in claim 1 wherein said tantalum is present in an amount of 0.50% by weight, said hafnium is present in an amount of 0.50% by weight, said zirconium is present in an amount of 0.25% by weight, said carbon is present in an amount of 0.1215% by weight and a remaining balance of 100% is molybdenum.

13. The X-ray tube anode target as defined in claim 1 wherein said tantalum is present in an amount of 0.50% by weight, said hafnium is present in an amount of 0.50% by weight, said zirconium is present in an amount of 0.50% by weight, said carbon is present in an amount of 0.2700% by weight and a remaining balance of 100% is molybdenum.

14. The X-ray tube anode target as defined in claim 1 wherein said tantalum is present in an amount of 0.50% by weight, said hafnium is present in an amount of 0.50% by weight, said zirconium is present in an amount of 0.50% by weight, said carbon is present in an amount of 0.1480% by weight and a remaining balance of 100% is molybdenum.

15. The X-ray tube anode target as defined in claim 1 wherein said tantalum is present in an amount of 0.75% by weight, said hafnium is present in an amount of 0.75% by weight, said zirconium is present in an amount of 0.50% by weight, said carbon is present in an amount of 0.3580% by weight and a remaining balance of 100% is molybdenum.

16. The X-ray tube anode target as defined in claim 1 wherein said tantalum is present in an amount of 0.75% by weight, said hafnium is present in an amount of 0.75% by weight, said zirconium is present in an amount of 0.50% by weight, said carbon is present in an amount of 0.2015% by weight and a remaining balance of 100% is molybdenum.

17. The X-ray tube anode as defined claim 1 further including a graphite portion.

* * * * *

UNITED STATES PATENT AND TRADEMARK OFFICE

CERTIFICATE OF CORRECTION

PATENT NO. : 5,222,116

DATED : June 22, 1993

INVENTOR(S) : Peter C. Eloff and Gregory Reznikov

It is certified that error appears in the above-identified patent and that said Letters Patent is hereby corrected as shown below:

| | |
|---|---|
| Column 1, lines 61 and 62 | after "of a" "tung-stenbased" should be --tungsten-based--. |
| Column 2, lines 65 and 66 | before "alloy" "tung-stenrhenium" should be --tungsten-rhenium--. |
| Column 5, | |
| Claim 7, line 4 | before "weight" one "by" should be deleted. |
| Claim 7, line 4 | before "said carbon" --said zirconium is present in an amount of 0.25% by weight-- should be added. |

Signed and Sealed this

Twenty-second Day of March, 1994

*Attest:*

*Attesting Officer*

BRUCE LEHMAN

*Commissioner of Patents and Trademarks*